US005697821A

United States Patent [19]

Ogino

[11] Patent Number: 5,697,821

[45] Date of Patent: Dec. 16, 1997

[54] BEARING CARRIER FOR OUTBOARD DRIVE

[75] Inventor: Hiroshi Ogino, Hamamatsu, Japan

[73] Assignee: Sanshin Kogyo Kabushiki Kaisha, Hamamatsu, Japan

[21] Appl. No.: 455,181

[22] Filed: May 31, 1995

Related U.S. Application Data

[63] Continuation-in-part of Ser. No. 346,397, Nov. 29, 1994, Pat. No. 5,575,698.

[30] Foreign Application Priority Data

Nov. 29, 1993 [JP] Japan ..... HEI 5-298656
May 31, 1994 [JP] Japan ..... HEI 6-118711

[51] Int. Cl.[6] ..... B63H 5/10

[52] U.S. Cl. ..... 440/80; 440/81; 440/83

[58] Field of Search ..... 440/49, 75, 79, 440/80, 81, 82, 83; 416/128, 129

[56] References Cited

U.S. PATENT DOCUMENTS 537,612 4/1895 Leathers .
599,125 2/1898 Fefel .
624,674 5/1899 Painton .
938,911 11/1909 Taylor .
1,807,254 5/1931 Piano .
1,813,552 7/1931 Stechauner .
1,853,694 4/1932 Melcher .
2,058,361 10/1936 Sherwood .
2,064,195 12/1936 De Michelis .
2,347,906 5/1944 Hatcher .
2,372,247 3/1945 Billing .
2,672,115 3/1954 Conover .
2,987,031 6/1961 Odden .
2,989,022 6/1961 Lundquist .
3,478,620 11/1969 Shimanckas .
3,769,930 11/1973 Pinkerton .
4,529,387 7/1985 Brandt .
4,540,369 9/1985 Caires .
4,619,584 10/1986 Brandt .
4,642,059 2/1987 Nohara .
4,741,670 5/1988 Brandt .
4,767,269 8/1988 Brandt .
4,790,782 12/1988 McCormick .
4,792,314 12/1988 McCormick .
4,793,773 12/1988 Kinouchi et al. .
4,795,382 1/1989 McCormick .
4,828,518 5/1989 Kouda et al. .
4,832,570 5/1989 Solia .
4,832,636 5/1989 McCormick .
4,840,136 6/1989 Brandt .
4,887,982 12/1989 Newman et al. .
4,887,983 12/1989 Bankstahl et al. .
4,897,058 1/1990 McCormick .
4,932,907 6/1990 Newman et al. .
4,963,108 10/1990 Koda et al. .
4,993,848 2/1991 John et al. .
5,009,621 4/1991 Bankstahl et al. .
5,017,168 5/1991 Ackley .
5,030,149 7/1991 Fujita .
5,186,609 2/1993 Inoue et al. .
5,230,644 7/1993 Meisenburg et al. .
5,232,386 8/1993 Gifford .
5,249,995 10/1993 Meisenburg et al. ..... 440/81
5,342,228 8/1994 Magee et al. .
5,344,349 9/1994 Meisenburg et al. .
5,352,141 10/1994 Shields et al. .
5,366,398 11/1994 Meisenburg et al. .

*Primary Examiner*—Stephen Avila
*Attorney, Agent, or Firm*—Knobbe, Martens, Olson & Bear, LLP

[57] ABSTRACT

A bearing carrier and ring nut of a marine outboard drive both attach to a lower unit of the drive by rotating them in the same direction. The bearing carrier includes a threaded front end which screws into a threaded aperture within the lower unit. A ring nut locks the bearing carrier in place by screwing into a hole on the rear face of the lower unit. A locking tab washer desirably locks the ring nut in place. Because the threads on the bearing carrier and the ring nut are of the same hand, the ring nut does not loosen the bearing carrier when threaded into the hole of the lower unit rear face.

19 Claims, 7 Drawing Sheets

BEARING CARRIER FOR OUTBOARD DRIVE

RELATED CASES

The present application is a continuation-in-part of U.S. application Ser. No. 08/346,397, filed on Nov. 29, 1994, now U.S. Pat. No. 5,575,678. In addition, the present application and the parent application each claim foreign priority from Japanese Patent Application Ser. Nos. Hei 6-118711 and Hei 5-298656, respectively.

BACKGROUND OF THE INVENTION

1. Field of the Invention

The present invention relates in general to a marine propulsion system, and more particularly to a propulsion shaft bearing carrier of an outboard drive.

2. Description of Related Art

Outboard drives, whether drives of outboard motors or stern drives of an inboard-outboard motors, commonly include a drive shaft and at least one propulsion shaft which extend at right angles to each other. Some form of driving mechanism, normally a forward-neutral-reverse transmission, interconnects the drive shaft and the propulsion shaft to drive the propulsion shaft. The rear end of the propulsion shaft extends through an opening in the rear face of the lower unit and connects to a propulsion device, such as, for example, a propeller. A detachable bearing carrier normally supports the propulsion shaft between the transmission and the rear opening of the lower unit.

The bearing carrier conventionally is assembled with the lower unit by screwing a front end of the bearing carrier into a threaded hole within the lower unit. A ring nut is screwed into the rear opening at the rear face of the lower unit to hold and position a rear end of the bearing carrier. The threads on the bearing carrier and on the ring nut conventionally are of opposite hand in order to lock the bearing carrier onto the lower unit.

SUMMARY OF THE INVENTION

The present invention includes the recognition that prior bearing carriers are often loosened when the ring nut is screwed into the rear opening of the lower unit because of the opposite hand of the threads. A need therefore exists for a locking bearing carrier which is easily and securely attached to the lower unit.

In accordance with one aspect of the present invention, a marine outboard drive comprises a lower unit housing. The housing includes first and second threaded apertures. A bearing carrier is adapted to generally fit within the lower unit housing and including an externally threaded first end. The first end is configured to screw into the first threaded aperture of the lower unit housing. An externally threaded ring nut is configured to screw into the second aperture. In this position, the ring nut cooperates with a second end of the bearing carrier to fix the bearing carrier within the lower unit housing with the first end screwed into the first aperture. The external threads on the ring nut are of the same hand as that of the external threads of the bearing carrier first end.

Another aspect of the present invention involves a marine outboard drive comprising a lower unit housing, a propulsion shaft bearing carrier, and a ring nut. The bearing carrier includes first and second ends. The first end of the bearing carrier is adapted to be coupled to the lower unit housing when the bearing carrier is rotated about its longitudinal axis in a first rotational direction. The ring nut also is adapted to engage the lower unit housing and to cooperate with the second end of the bearing carrier to fix the bearing carrier to the lower unit housing. The ring nut engages the lower unit when rotated relative to the lower unit in the first rotational direction.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF PREFERRED EMBODIMENTS

Figure 1:
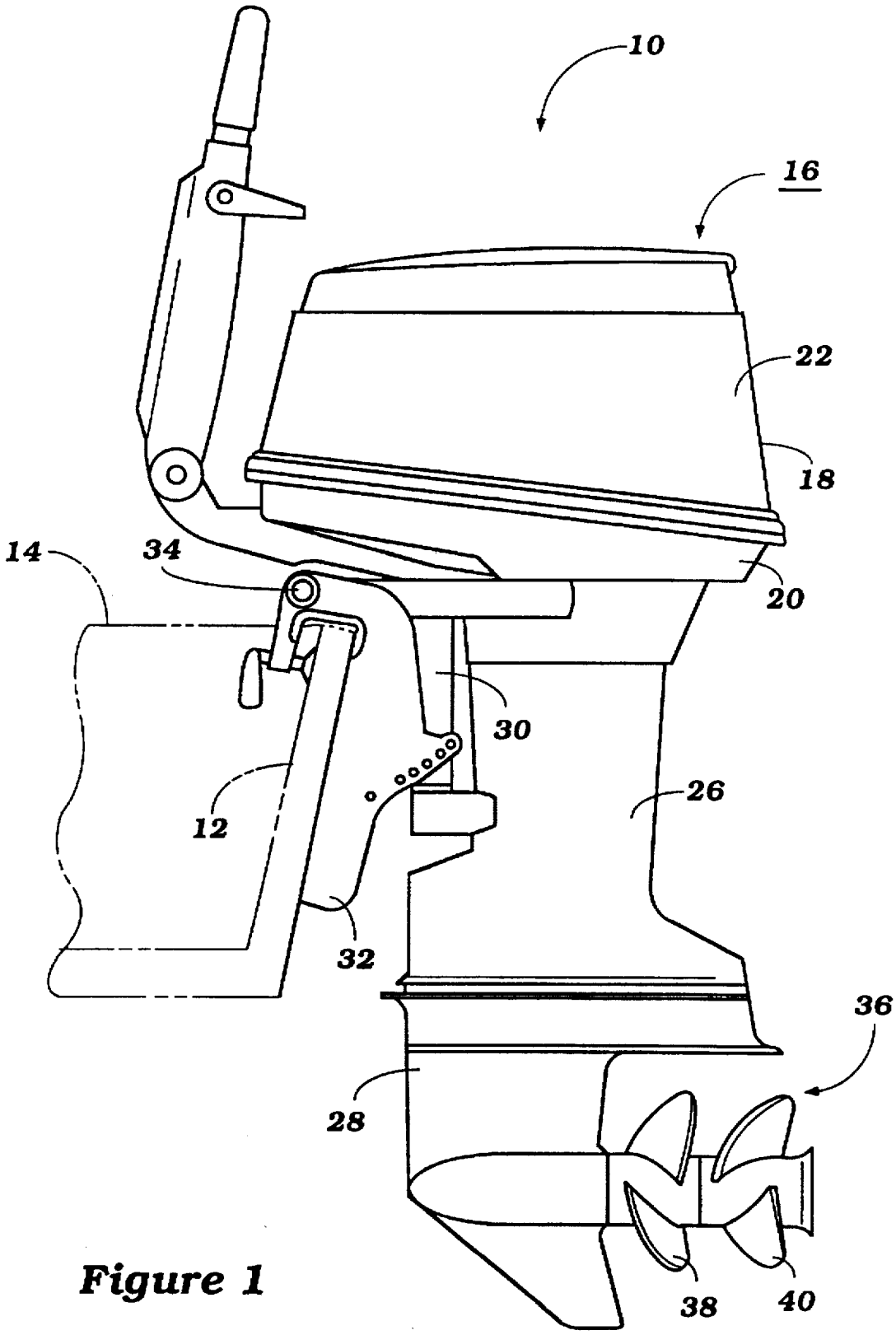
FIG. 1 is a side elevational view of an outboard drive in accordance with a preferred embodiment of the present invention.

FIG. 1 illustrates a marine outboard drive 10 of the type which can embody the present bearing carrier and transmission. In the illustrated embodiment, the outboard drive 10 is depicted as an outboard motor for mounting on a transom 12 of a watercraft 14. It is contemplated, however, that those skilled in the art will readily appreciate that the present invention can be applied to stern drive units of inboard-outboard motors as well.

In the illustrated embodiment, the outboard drive 10 has a power head 16 which includes an engine. A conventional protective cowling 18 surrounds the engine. The cowling 18 desirably includes a lower tray 20 and a top cowling member 22. These components 20, 22 of the protective cowling 18 together define an engine compartment which houses the engine.

The engine is mounted conventionally with its output shaft (i.e., crankshaft) rotating about a generally vertical axis. The crankshaft (not shown) drives a drive shaft 24 (FIG. 2), as known in the art. The drive shaft 24 depends from the power head 16 of the outboard drive 10.

A drive shaft housing 26 extends downward from the lower tray 20 and terminates in a lower unit 28. The drive shaft 24 extends through and is journaled within the drive shaft housing 26, as known in the art.

A steering bracket 30 is attached to the drive shaft housing 26 in a known matter. The steering bracket 30 also is pivotably connected to a clamping bracket 32 by a pin 34. The clamping bracket 32, in turn, is configured to attach to a transom 12 of the watercraft 14. This conventional coupling permits the outboard drive 10 to be pivoted relative to the clamping bracket 32 for steering purposes, as well as to be pivoted relative to the pin 34 to permit adjustment to the trim position of the outboard drive 10 and for tilt up of the outboard drive 10. Although not illustrated, it is understood that a conventional hydraulic tilt and trim cylinder assembly, as well as a conventional hydraulic steering cylinder assembly could be used as well with the present outboard drive 10.

The engine of outboard motor 10 drives a propulsion device 36, such as, for example, a propeller, a hydrodynamic jet, or the like. In the illustrated embodiment of FIG. 1, the propulsion device 36 is a counter-rotating propeller device that includes a front propeller 38 designed to spin in one direction and to assert a forward thrust, and a rear propeller 40 designed to spin in an opposite direction and to assert a forward thrust.

Figure 2:
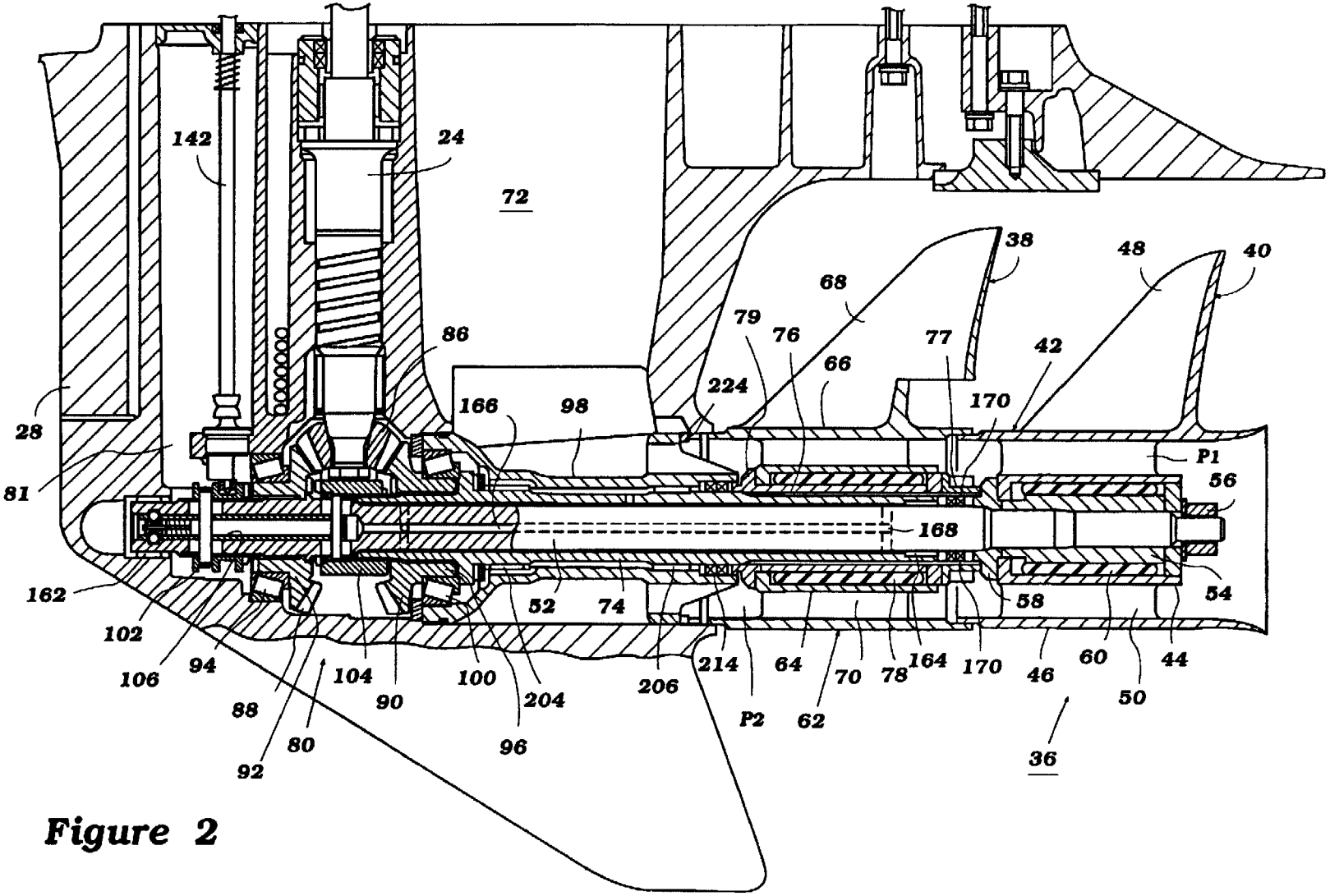
FIG. 2 is a sectional side elevational view of a lower unit of the outboard drive of FIG. 1.

FIG. 2 illustrates the components of the front and rear propellers 38, 40. The rear propeller 40 includes a boss 42 which is formed in part by an inner sleeve 44 and by an outer sleeve 46 to which the propeller blades 48 are integrally formed. A plurality of radial ribs 50 extend between the inner sleeve 44 and the outer sleeve 46 to support the outer sleeve 46 about the inner sleeve 44 and to form a passage $P_1$ through the propeller boss 42. Engine exhaust is discharged through the passage $P_1$, as known in the art.

An inner propulsion shaft 52 drives the rear propeller boss 42. For this purpose, the rear end of the inner shaft 52 carries an engagement sleeve 54 having a spline connection with the rear end of the inner shaft 52. The sleeve 54 is fixed to the rear end of the inner shaft 52 between a nut 56 threaded on the rear end of the shaft 52 and a conventional thrust washer 58 positioned between the front and rear propellers 38, 40. The thrust washer 58 cooperates with the propeller boss 42 to transfer a driving thrust from the propeller 40 to the shaft 52.

An elastic bushing 60 is interposed between the engagement sleeve 54 and the rear propeller boss 42 and is compressed therebetween. The bushing 60 is secured to the engagement sleeve 54 by a heat process known in the art. The frictional engagement between the boss 42, the elastic bushing 60, and the engagement sleeve 54 is sufficient to transmit rotational forces from the sleeve 54, driven by the inner propulsion shaft 52, to the rear propeller blades 48.

The front propeller 38 likewise includes a front propeller boss 62. The front propeller boss 62 has an inner sleeve 64 and an outer sleeve 66. Propeller blades 68 of the front propeller 38 are integrally formed on the exterior of the outer sleeve 64. Ribs 70 interconnect the inner sleeve 64 and the outer sleeve 66 and form an axially extending passage $P_2$ between the sleeves 64, 66. The passage $P_2$ communicates with a conventional exhaust discharge passage 72 in the lower unit and with the exhaust passage $P_1$ of the rear propeller boss 42.

An outer shaft 74 carries the front propeller 38. As best seen in FIG. 2, the outer shaft 74 carries a front engagement sleeve 76 at its rear end of in driving engagement through a spline connection. The front engagement Sleeve 76 is secured onto the outer shaft between a nut 77 threaded onto the rear end of the outer shaft 74 and a conventional thrust washer 79 which engages the outer shaft 74 in a known manner.

A front annular elastic bushing 78 surrounds the front engagement sleeve 76. The bushing 78 is secured to the sleeve 76 by heat process known in the art.

The front propeller boss 62 surrounds the elastic bushing 78, which is held under pressure between the boss 62 and the sleeve 76 in frictional engagement. The frictional engagement between the propeller boss 62 and the bushing 78 is sufficient to transmit a rotational force from the sleeve 76 to the propeller blades 68 of the front propeller boss 62.

As seen in FIG. 2, the inner and outer propulsion shafts 52, 74 and the drive shaft 24 desirably extend at generally right angles to each other. A transmission 80 selectively interconnects the drive shaft to the propulsion shafts 52, 74. The lower unit 28 houses the transmission 80 in a sealed transmission case 81.

The transmission 80 advantageously is a forward/neutral/reverse-type transmission. The transmission 80 simultaneously drives the inner and outer propulsion shafts 52, 74 in one direction and in a counter direction, respectively, under a forward drive condition. Because the pitch of the propeller blades 48, 68 are of opposite hand, the oppositely spinning blades 48, 68 both assert a forward driving thrust when driven under a forward drive condition. Under a reverse drive condition, the transmission desirably drives only one of the propellers 38, 40. In the illustrated embodiment, the transmission drives only the outer propulsion shaft 52 and thus the front propeller 38 under a reverse drive condition; however, the transmission 80 can be configured alternatively to drive the rear the propeller 40 or both propellers 38, 40 when driven under a reverse drive condition.

As seen in FIG. 2, the drive shaft 24 carries a drive gear or pinion 86 at its lower end, which is disposed within the transmission case 81 of the lower unit 28 and which forms a portion of the transmission 80. The drive gear 86 preferably is a bevel type gear.

The transmission 80 also includes a pair of counter-rotating driven gears 88, 90 that are in mesh engagement with the drive gear 86. The pair of driven gears 88, 90 preferably are positioned on diametrically opposite sides of the drive gear 86, and are suitably journaled within the lower unit 28, as described below. Each driven gear 88, 90 is positioned at about a 90° shaft angle with the drive gear 86. That is, the propulsion shafts 52, 74 and the drive shaft 24, desirably intersect at about a 90° shaft angle; however, it is contemplated that the drive shaft 24 and the propulsion shafts 52, 74 can intersect at almost any angle.

In the illustrated embodiment, the pair of driven gears are a front bevel gear 88 and an opposing rear bevel gear 90. The front gear 88 includes a hub 92 which is journaled within the transmission case 81 of the lower unit 28 by a front thrust bearing 94. The front thrust bearing 94 rotatably supports the front gear 88 in mesh engagement with the drive gear 56. The rear gear 90 also includes a hub 96 which is suitably journaled within a bearing carrier 98 of the lower unit 28 by a rear thrust bearing 100. The rear thrust bearing 100 rotatably supports the rear gear 90 in mesh engagement with the drive gear 86.

Figure 3:
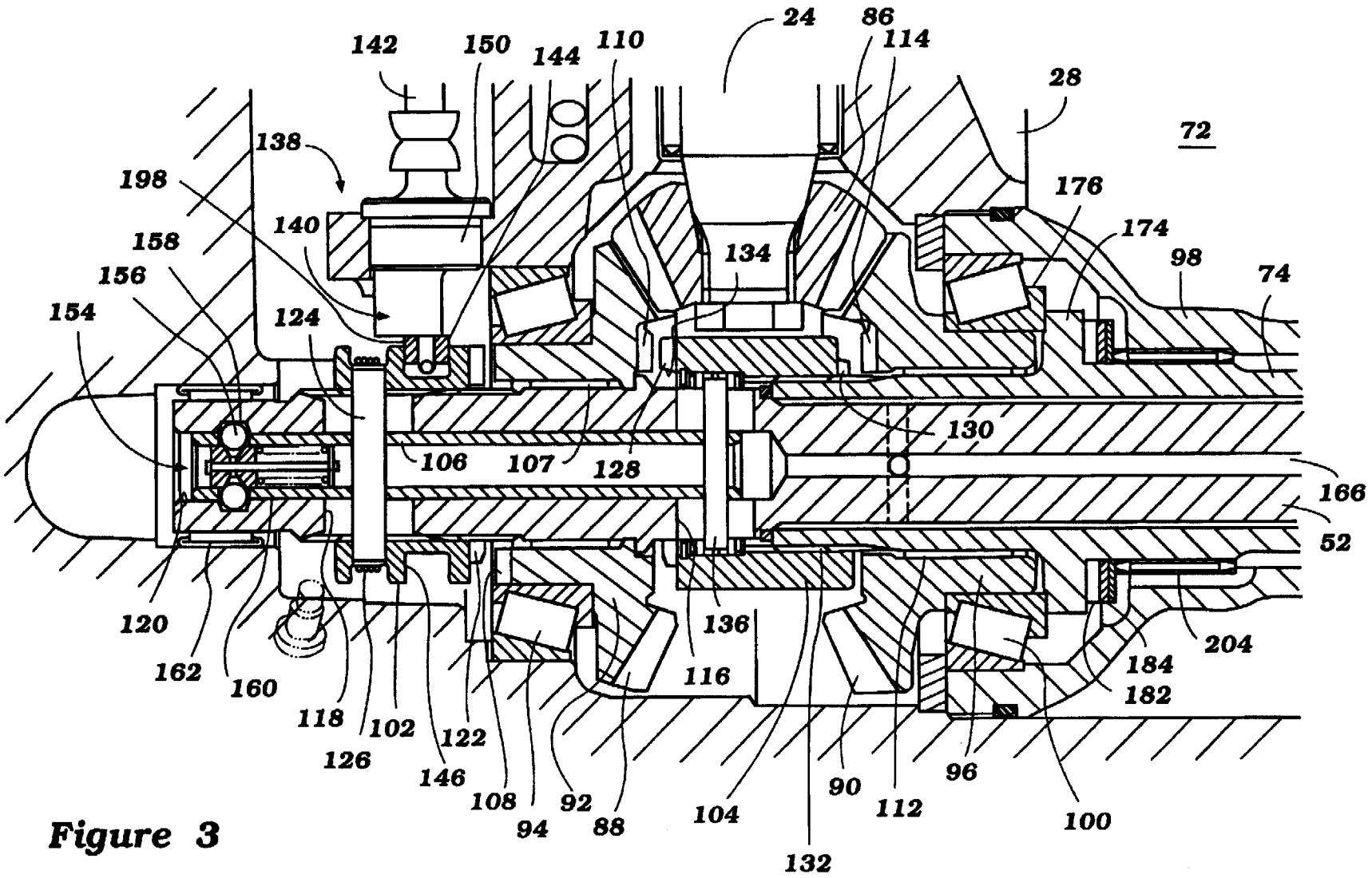
FIG. 3 is an enlarged sectional side elevational view of a transmission of the lower unit of FIG. 2.

FIG. 2 also illustrates a front clutch 102 and a rear clutch 104 of the present transmission 80. In the illustrated embodiment, plunger 106 interconnects the clutches 102, 104 for simultaneous operation. FIGS. 2 and 3 illustrates the front and rear clutches 102, 104 in a neutral position (i.e., in a position in which the clutches 102, 104 do not engage either the front gear 88 or the rear gear 90).

As discussed in detail below, the front clutch 102 selectively couples the inner propulsion shaft 52 to the front gear 88. The rear clutch 104 selectively couples the outer propulsion shaft 74 to either the front gear 88 or the rear gear 90. In the illustrated embodiment, the clutches 102, 104 are positive clutches, such as, for example, dog clutches; however, it is understood that the present transmission 80 can be designed with friction-type clutches. The individual components of the present transmission 80 will now be described in detail.

With reference to FIG. 3, the bearing hub 92 of the front gear 88 has a central bore through which the inner propulsion shaft 52 passes when assembled. A bushing 107 journals the front gear 88 on the inner propulsion shaft 52 when the shaft 52 passes through the central bore of the front gear hub 92.

The front gear 88 also includes a series of teeth formed on an annular front facing engagement surface 108 and on an annular rear facing engagement surface 110. The teeth on each surface 108, 110 positively engage a portion of the clutches 102, 104 of the transmission 80, as discussed below.

The hub 96 of the rear gear 90 also has a central bore through which the inner propulsion shaft 52 and the outer propulsion shaft 74 pass when assembled. A bushing 112 journals the rear gear 90 onto the outer shaft 74 when the outer shaft 74 passes through its central bore.

The rear gear 90 also includes an annular front engagement surface 114 which carries a series of teeth for positive engagement with the rear clutch 104 of the transmission 80, as discussed below.

As seen in FIG. 3, the driven gears 88, 90 are journaled about the inner shaft 52 at positions generally symmetric to the axis of the drive shaft 24. In this position, the gears 88, 90 lie to the sides of a rear aperture 116 of the inner drive shaft 52. The rear aperture 116 extends through the inner shaft 52, transverse to the axis of the inner shaft 52. The inner shaft 52 also includes a front aperture 118 that extends transverse to the axis of the shaft 52, at a position forward of the front bevel gear 88.

The front end of the inner propulsion shaft 52 includes a longitudinal bore 120 which is sized to receive the plunger 106. The bore 120 stems from the front end of the inner shaft 52 to a bottom surface which is positioned beyond the intersection between the axis of the drive shaft 24 and the axis of the inner shaft 52.

The front clutch 102 is arranged in front of the front gear 88 on the inner shaft 52. The front clutch 102 has a generally spool-like shape and includes an axial bore which extends between an annular front end and a flat annular rear end 122. The rear end 122 of the clutch 102 extends generally transverse to the longitudinal axis of the clutch 102. The bore is sized to receive the inner propulsion shaft 52.

The rear surface 122 of the front clutch 102 is substantially coextensive in area with the annular front engagement surface 108 of the front gear 88. Teeth extend from the clutch rear surface 122 in the longitudinal direction, and desirably correspond to the teeth of the front engagement surface 108 of the front gear 88, both in size (e.g., axial length) and in configuration.

The front clutch 102 includes a spline connection to the inner propulsion shaft 52. Internal splines of the front clutch 102 matingly engage external splines on the external surface of the inner drive shaft 52. This spline connection provides a driving connection between the front clutch 102 and the inner propulsion shaft 52, yet permits the front clutch 102 to slide over the inner propulsion shaft 52, as discussed below.

The front clutch 102 also includes a hole that extends through the midsection of the clutch 102 in a direction generally transverse to the longitudinal axis of the clutch 102. The hole is sized to receive a pin 124, which, when passed through the front aperture 118 of the inner propulsion shaft 52 and through a front hole in the plunger 106, interconnects the plunger 106 and the front clutch 102, with a portion of the inner shaft 52 interposed therebetween. The pin 124 may be held in place by a press-fit connection between the pin 124 and the hole of the clutch 102, or by a conventional coil spring 126 which is contained within a groove about the front clutch 102.

As also seen in FIG. 3, the rear dog clutch 104 generally has a tubular shape and includes an axial bore that extends between a flat annular front end surface 128 and a flat annular rear end surface 130. The bore is sized to receive the inner propulsion shaft 52 and a portion of the outer propulsion shaft 74.

The annular end plates 128, 130 of the rear clutch 104 are substantially coextensive in size with the annular engagement surfaces 110, 114 of the front and rear gears 88, 90, respectively. Teeth extend from each end surface 128, 130 of the rear clutch 104. The teeth desirably correspond to the respective teeth of the front and rear gears 88, 90 both in size (e.g., axial length) and in configuration.

The rear clutch 104 has a spline connection 132 to the outer propulsion shaft 74 which establishes a drive connection between the rear clutch 104 and the shaft 74, yet permits the clutch 104 to slide along the axis of the shaft 74 between the front and rear gears 88, 90. The rear clutch 104 specifically includes internal splines within the bore that mate with corresponding external splines on the outer periphery of the front end of the outer propulsion shaft 74.

The rear clutch 104 also includes a counterbore 134. The counterbore 134 is sized to receive a pin 136 which extends through the rear aperture 116 of the inner propulsion shaft 52 and through a rear hole of the plunger 106 when assembled. Roller bearing assemblies, which are captured within the counterbore 134, desirably journal the pin 136 within the counterbore 134 of the rear clutch 104. In this manner, the rear clutch 104 is rotatably coupled to the plunger 106, while drivingly connected to the outer propeller shaft 74.

The plunger 106 interconnects the front and rear clutches 102, 104, as noted above. The plunger 106 has a generally cylindrical rod shape and slides within the longitudinal bore 120 of the inner shaft 52 to actuate the clutches 88, 90. The plunger 106 may be solid; however, it is preferred that the plunger 106 be hollow (i.e., a cylindrical tube), especially where a neutral detent mechanism of the type described below is used.

An actuator mechanism 138 moves the plunger 106 from a position in which the front and rear clutches 102, 104 engage the first and second gears 88, 90, respectively, through a position of non-engagement (i.e., the neutral position), and to a position in which the rear clutch 104 engages the front gear 88. The actuator mechanism 138 positively reciprocates the plunger 106 between these positions. FIGS. 2 and 3 best illustrate an exemplary embodiment of the actuator mechanism.

As seen in FIG. 3, the actuator mechanism 138 includes a cam member 140 which couples the plunger 106 to a rotatable shift rod 142. In the illustrated embodiment, the shift rod 142 depends in the vertical direction through the drive shaft housing 26 and into the transmission case 81 in the lower unit 28. The actuator mechanism 138 also includes a remote gear shifter, which is conventionally mounted proximate to the steering controls of the watercraft (not shown). The gear shifter includes a shift lever which is coupled to a conventional shift slider via a bowden wire cable. The shift slider connects to a lever arm, which in turn connects to one end of a link. An opposite end of the link is fixed to the shift rod 142 so as to move the cam member 140 of the actuator mechanism 138 in response to movement of the shift lever, as known in the art. In this manner, the actuator mechanism 138 controls the transmission 80.

In the illustrated embodiment, the cam member 140 converts rotational movement of the shift rod 142 into linear movement of the plunger 106 to move the plunger 106 and the clutches 102, 104 generally along the axis of the propulsion shafts 52, 54. As best seen in FIG. 3, the cam member 140 is affixed to a lower end of the shift rod 142. The cam member 140 includes an eccentrically positioned drive pin 144 which extends into an annular groove 146 that circumscribes the front clutch 102. Roller bearings 148 journal the pin 144 within the groove 146 of the front dog clutch 102. The front clutch 104 thus is coupled to the cam member 140 in a manner in which rotational movement of the cam member 140 moves the front clutch 102 linearly along the inner drive shaft 52, while permitting the clutch 102 to rotate with the inner propeller shaft 52, relative to the cam member 140.

The cam member 140 also includes a cylindrical upper bearing 150 and a smaller diameter, cylindrical lower member 152. The upper bearing 150 is positioned to rotate about the axis of the shift rod 142 and is suitable journaled within the lower unit 28. The lower member 152 is eccentrically positioned relative to the axis of the shift rod 142 and upper bearing 150.

The present transmission 80 and actuator mechanism 138 additionally may include a neutral detent mechanism 154 to hold the plunger 106 (and the coupled clutches 102, 104) in the neutral position. FIG. 3 illustrates an embodiment of a neutral detent mechanism 154 used with the hollow plunger 106. The detent mechanism 154 operates between the plunger 106 and the inner bore 120 of the propulsion shaft 52, as described below.

The neutral detent mechanism 154 is formed in part by at least one, and preferably at least two transversely positioned holes in the hollow plunger 106. These holes receive detent balls 156. The detent balls 156 each have a diameter slightly smaller than diameter of each transverse hole in the plunger 106.

As seen in FIG. 3, the inner propulsion shaft 52 includes an annular groove 158 which is formed on the inner wall of the bore 120 through which the plunger 106 slides. The groove 158 is positioned within the bore 120 so as to properly locate the clutches 102, 104 in the neutral position when the detent balls 156 of the plunger 106 coincide with the axial position of the annular groove 158.

A spring plunger 160, formed in part by a helical compression spring, biases the detent balls 156 radially outward, against the inner wall of the inner propulsion shaft bore 120. The plunger 106 contains the spring plunger 160 within its bore. The spring plunger 160 forces portions of the detent balls 156 into the annular groove 158 when the plunger 106 is moved into the neutral position. This releasably connection between the detent balls 156 carried by the plunger 106 and the groove 158 of the inner propulsion shaft 52 releasably restrains movement of the plunger 106 relative to the inner propulsion shaft 52, as known in the art. Because the detent mechanism 154 is believed to be conventional, further description of the detent mechanism 154 is thought unnecessary for an understanding of the present invention.

With reference to FIGS. 2 and 3, the inner and outer propulsion shafts 52, 74 extend from the transmission 80 to the propulsion device 36 to drive the propulsion device 36 when selectively driven by the transmission 80. In the illustrated embodiment, a front end of the inner propulsion shaft 52 is supported within the lower unit 28 in front of the front clutch 102. A front needle bearing assembly 162 journals a front end of the inner propulsion shaft 52 in this position. The inner propulsion shaft 52, as noted above, extends through front gear hub 92 and the rear gear hub 96. On the rear side of the rear gear 90, the inner shaft 52 extends through the outer shaft 74 and, as seen in FIG. 2, is suitable journaled therein in part by a needle bearing assembly 164 which supports the inner shaft 52 at the rear end of the outer shaft 74.

The inner shaft 52 includes a central lubricant passage 166 which extends from the rear end of the longitudinal bore 120 to a plurality of transverse holes 168 positioned proximate to the rear needle bearing assembly 164. This passage 166 permits lubricant flow between the inner and outer shafts 52, 74 and to the rear needle bearing assembly 164.

A first pair of seals 170 (e.g., oil seals) is interposed between the inner shaft 52 and the outer shaft 74 at the rear end of the outer shaft 74. The seals 170 substantially prevent lubricant flow beyond this point.

Figure 4:
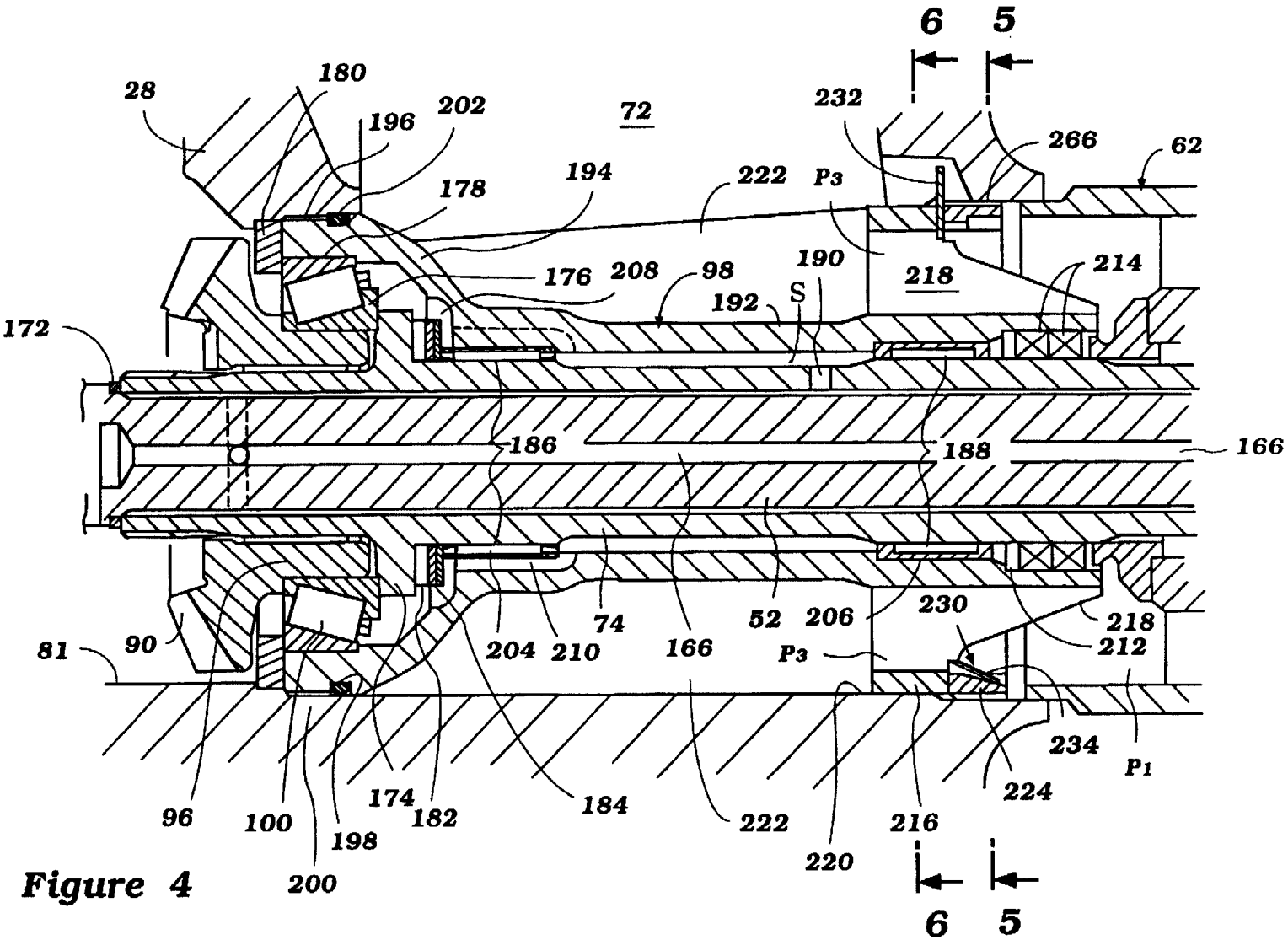
FIG. 4 is an enlarged sectional side elevational view of a bearing carrier of the lower unit of FIG. 2.

With reference to FIG. 4, the outer shaft 74 includes a narrowed front end which supports the external spines that engage the rear clutch 102. The front end of the outer shaft 74 lies within a step formed on the inner shaft 52. An anti-friction washer 172 sits within the step to minimize friction between the counter-rotating shafts 52, 74.

The outer shaft 74 includes a thrust flange 174 formed behind the front end of the outer shaft 74 and positioned to engage the inner race 176 of the rear thrust bearing assembly 100. The thrust flange 174 loads the inner race 176 of the bearing assembly 100 in an opposite direction to the force loading applied by the rear gear 90. This thrust bearing arrangement thus reduces the thrust loading on the rear thrust bearing assembly 100 as the opposing loadings cancel each other to some degree. The resultant forward thrust loading produced under a forward drive condition is transferred to the outer race 178 of the bearing assembly 100 and then to a shim ring 180 fixed within the lower unit 28.

The rear side of the thrust flange 174 contacts a needle-like thrust bearing assembly 182 which act against an anti-friction washer 184. The washer 184 contacts an inner shoulder of the bearing carrier 98 to minimize friction between the bearing carrier 98 and the rotating outer shaft 74, and to allow the transfer of the rearward thrust loading from the shaft 74 to the bearing carrier 82.

The outer shaft 74 also includes a pair of spaced bearing surfaces 186, 188 formed behind the thrust flange 174. The outer shaft has a reduced diameter between the bearing surfaces 186, 188 to form an lubricant passage S between the bearing surfaces 186, 188. The outer shaft also includes a plurality of transverse holes 190 which permit lubricant flow into the space between the inner and outer propulsion shafts 52, The bearing carrier 98 includes a tubular section 192 which flares radially outwardly into an enlarged front end 194 that receives the rear gear bearing hub 96, as described above. The enlarged front end 194 carries an external thread 196 about its periphery. The threads 196 are formed in front of an O-ring groove 198. The O-ring groove 198 circumscribes the enlarged front end 194 of the bearing carrier 98 directly behind the external threads 196.

The threads 196 correspond in pitch and hand to a series of internal threads formed on an inner hole 200 within the lower unit 28. The inner hole 200 is located directly behind the transmission case 81. When assembled, the enlarged front end 194 of the bearing carrier 98 is screwed into the inner hole 200 of the lower unit housing 28 until it contacts the shim ring 180. In this position, an O-ring 202, seated within the O-ring groove 198 and compressed between the lower unit housing 28 and the bearing carrier front end 194, seals the transmission case 81 about the periphery of the inner hole 200.

The tubular section 192 of the bearing carrier 98 includes recesses which receive needle bearing assemblies 204, 206 at positions corresponding to the axial position of the bearing surfaces 186, 188 of said outer shaft 74. When assembled, the needle bearing assemblies 204, 206 journal the outer shaft 74 within the bearing carrier 98 at its bearing surfaces 186, 188 to the rear of the rear gear 90. The front bearing assembly 204 lies directly behind the thrust flange 174 of the outer shaft 74, and the rear bearing assembly 206 lies at the end of the bearing carrier 98.

The bearing carrier 98 also includes lubricant passages 208, 210 about the rear thrust bearing assembly 182 and the front needle-bearing assembly 204 to permit lubricant flow into the space S between the tubular section 192 of the bearing carrier 98 and the outer shaft 74. A rear recess 212 of the bearing carrier 98 forms a seat for a pair of lubricant seals 214 at the rear end of the bearing carrier 98. The lubricant seals 214 prevent lubricant flow beyond this point.

Figure 5:
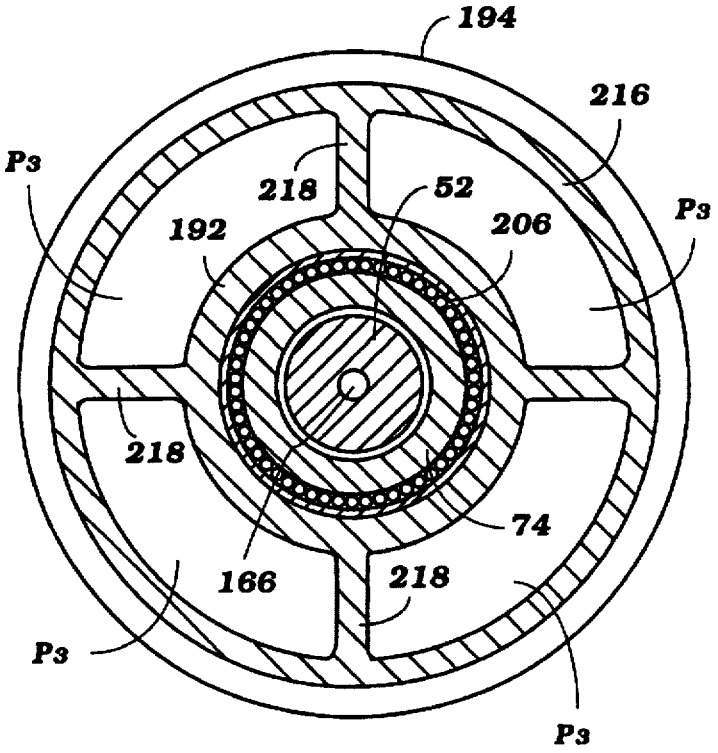
FIG. 5 is a cross-sectional view of the bearing carrier and a propulsion shaft assembly taken along line 5—5 of FIG. 4.

As best understood from FIGS. 4 and 5, an annular rear rim 216 of the bearing carrier 98 circumscribes the rear end of the tubular section 192. Ribs 218 interconnect the inner tubular section 192 with the outer rim 216 and form an axially extending passage P3 between the inner tubular section 192 and the outer rim 216. When assembled, the passage P3 communicates with the exhaust discharge passage 72 in the lower unit 28 and with the exhaust passage P2 of the front propeller boss 62.

The outer rim 216 has an outer diameter sized to fit within a threaded rear hole 220 formed on the rear face of the lower unit 28. When assembled, the outer rim 216 lies at least partially within the rear hole 220 with the enlarged front end 194 screwed into the inner threaded hole 200.

As seen in FIG. 4, the bearing carrier 98 also includes a plurality of longitudinal support ribs 222 that extend between the enlarged front end 194 and the rear rim 216. The ribs 222 strengthen the bearing carrier 98 without impeding exhaust flow through the lower unit 28.

An annular ring nut 224 secures the bearing carrier 98 to the lower unit 28. The ring nut 224 carries an external thread 226 which cooperates with the threaded rear hole 220 of the lower unit 28. The exterior threads 226 of the ring nut 224 are of the same hand as that of the external threads 196 of the enlarged front end 194 of the bearing carrier 98. The thread pitch between the threads, however, desirably is different. The threads 196 on the bearing carrier 98 preferably are coarser (i.e., of a larger thread pitch) than the threads 226 on the ring nut 224.

Because both the ring nut 224 and the bearing carrier 98 rotate in the same direction when attaching the ring nut 224 and the bearing carrier 98 to the lower unit 28, the ring nut 224 does not loosen the bearing carrier 98 when it is attached, as in prior outboard drives. The differing thread pitch also generally prevents the ring nut 224 and the bearing carrier 98 from rotating together.

The advantage of the present invention can be gained whether internal or external threads are used on the bearing carrier 98 and the ring nut 224. The present invention also can be practiced with other types of engagement or coupling mechanisms which engage or couple through rotation. By rotating the ring nut 224 in the same direction as the bearing carrier 98 when coupling these components to the lower unit 28, the bearing carrier 98 will not be loosened when subsequently attaching the ring nut 224.

Figure 6:
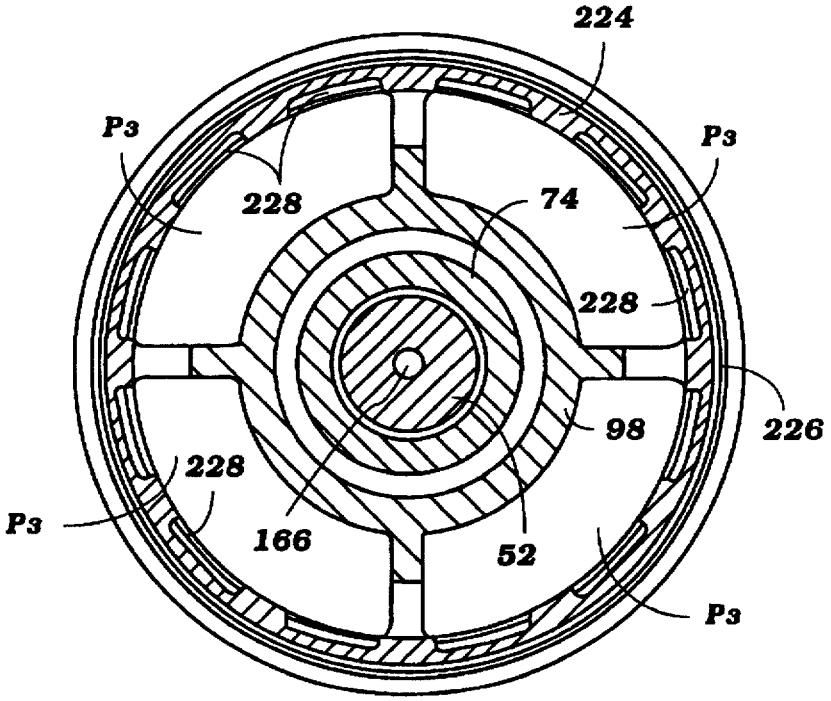
FIG. 6 is a cross-sectional view of the bearing carrier and propulsion shaft assembly taken along line 6—6 of FIG. 4.

As seen in FIG. 6, the ring nut 224 includes a plurality of reliefs 228 formed about the inner periphery of the ring nut 224, as know in the art. The reliefs 228 are sizes and positioned to receive a conventional tool used to tighten the ring nut 224 into the rear hole 220 of the lower unit 24.

With reference to FIGS. 4 and 6, a locking tab washer 230 locks the ring nut 224 onto the lower unit 24. When assembled, at least one external tab 232 of the washer 230 fits into a corresponding notch formed in the lower unit 28 at a location about the rear hole 220, to prevent rotation of the washer 230. The washer 230 is interposed between the rim 216 of the bearing carrier 98 and the ring nut 224. At least one internal tab 234 is bent into one of the inner reliefs 228 on the ring nut 224. In this manner, the ring nut 224 is locked onto the lower unit 28.

As best seen in FIG. 4, the ring nut 224 abuts the rear end of the bearing carrier rim 216. This contact prevents the moving of the bearing carrier rim 216 either axially or rotationally, thereby securing bearing carrier 98 to the lower unit housing 28.

Figure 7:
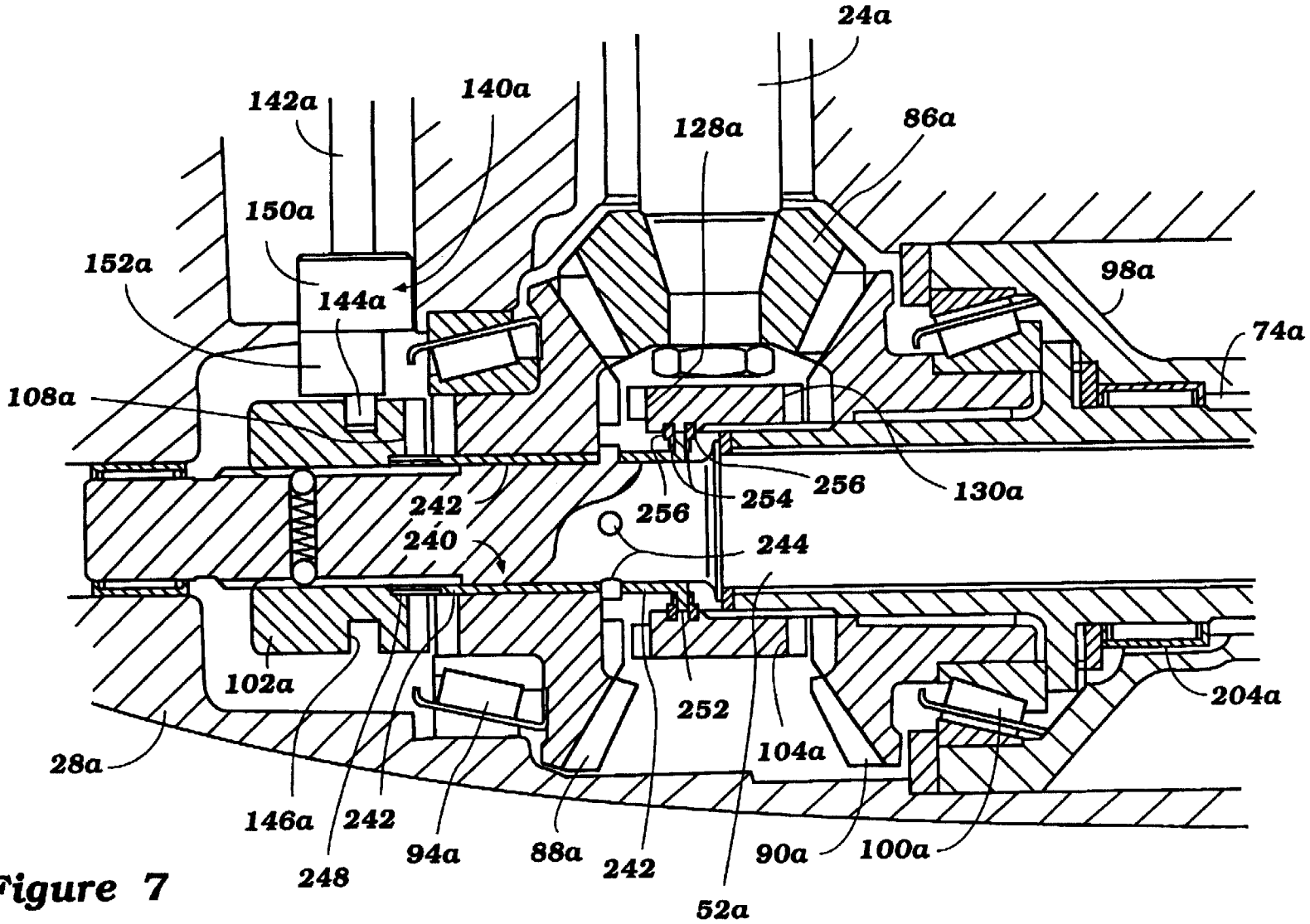
FIG. 7 is an enlarged sectional side elevational view of another preferred embodiment of a transmission which can be used with the present outboard drive.
Figure 8:
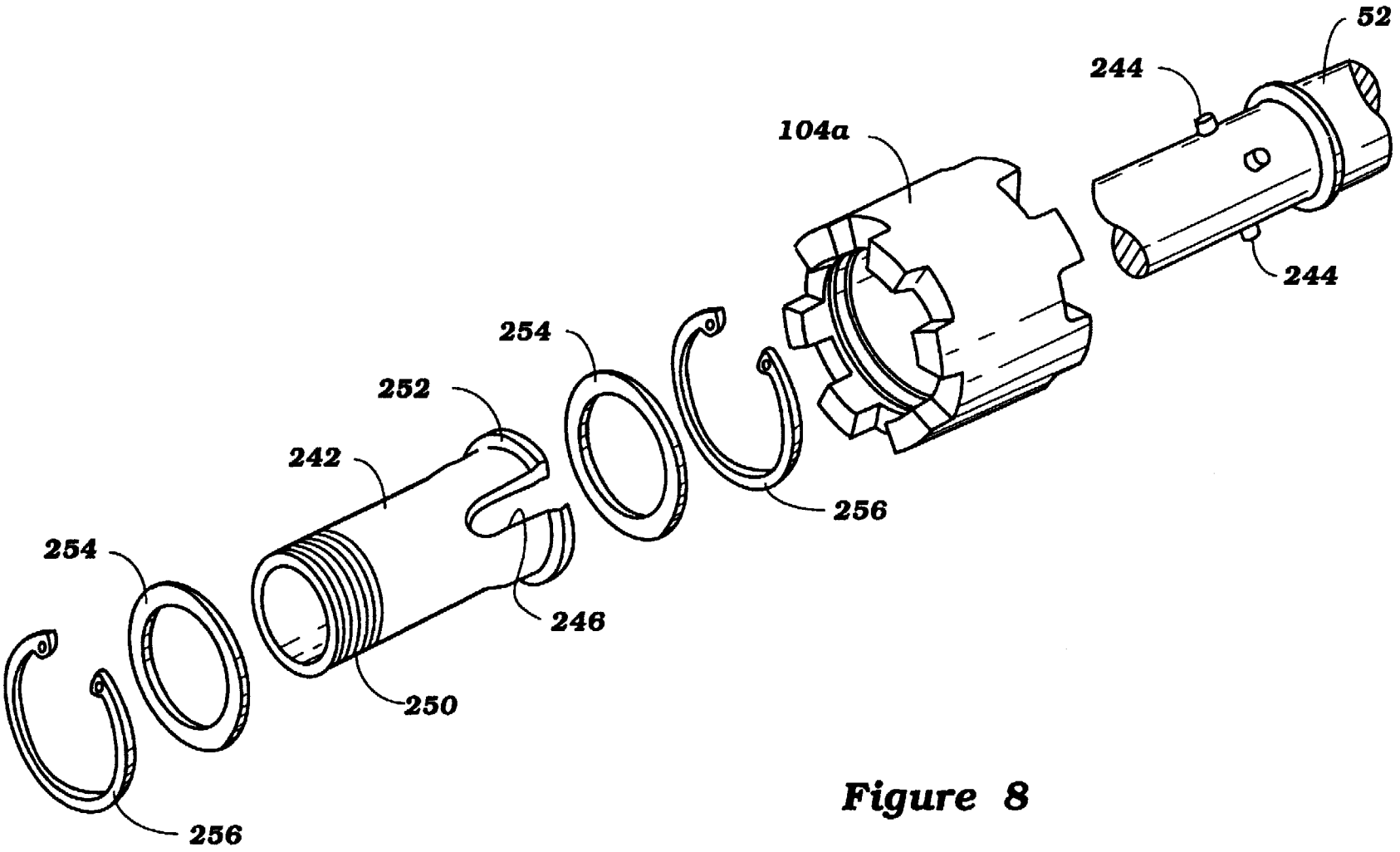
FIG. 8 is an exploded perspective view of a clutch coupling mechanism of the transmission of FIG. 7.

FIGS. 7 and 8 illustrate another preferred embodiment of a clutch actuator mechanism which can be used with the present transmission. Where appropriate, like numbers with an "a" suffix have been used to indicate like parts between the two embodiments for ease of understanding. The present transmission 80*a* is substantially identical to the transmission 80 described above, except for the configuration of the front clutch 102*a* and for the clutch coupling mechanism between the front and rear clutches 102*a*, 104*a*. Accordingly, the foregoing discussion should be understood as applying equally to the present transmission 80*a*, unless specified to the contrary.

As seen in FIG. 7, the front clutch 102*a* of the transmission 80*a* has a generally tubular shape and defines an inner bore between a front end and a rear engagement end 108*a*. The rear engagement end 108*a* carries a plurality of teeth to engage the front side of the front gear 88*a*. The inner bore receives the inner propulsion shaft 52*a* when assembled, and includes a plurality of interior splines which extend from the wall of the inner bore. The inner splines mate with external splines on the exterior of the inner propulsion shaft 52*a* to establish a spline connection between these components. The clutch 102*a* thus can slide axially over the inner propulsion shaft 52*a* and can rotatably drive the shaft 52*a*.

A cam member 140*a* connects the front clutch 102*a* to a rotatable shift rod 142*a*. The shift rod 142*a* is journaled for rotation in the lower unit 28*a* and extends upwardly to a transmission actuator mechanism (not shown) for reciprocating the cam member 140*a* and the front clutch 102*a* between the neutral position (shown in FIG. 7), a forward drive position where the front and rear clutches 102*a*, 104*a* engage the front and rear gears 88*a*, 90*a*, respectively, and a reverse drive position where the rear clutch 104*a* engages the front gear 88*a*.

The cam member is 140*a* affixed to the lower end of the shift rod 142*a*. The cam member 140*a* includes an eccentrically positioned drive pin 144*a* which depends from a cylindrical lower member 152*a* of the cam member 140*a*. The cam member 140*a* also includes a cylindrical upper bearing 150*a* which is suitably journaled within the lower unit 28*a*, as known in the art. The drive pin 144*a* is eccentrically positioned in relation to the axis of rotation of the shift rod 142*a*.

The front clutch includes an annular groove 146*a* which. circumscribes the tubular body of the clutch 102*a*. The width of the groove 146*a* substantially matches the diameter of the drive pin 144*a*. When assembled, as seen in FIG. 7, the drive pin 144*a* extends into the groove 146*a* and is captured between the side wall of the groove 146*a*. The drive pin 144a, however, does not interfere with the rotation of the clutch 102a which freely rotates relative to the cam member 140a when in the forward drive position.

As understood from FIG. 7, the drive pin 144a moves both axially and transversely with the rotation of the cam member 140a because of the eccentric position of the drive pin 144a relative to the rotational axis of the cam member 140a. For this purpose, the drive pin 144a freely moves within the groove 146a in the transverse direction while maintaining engagement with the front clutch 102a. The axial travel of the drive pin 144a causes the front clutch 102a to move axially, sliding over the inner propulsion shaft 52a.

The rear clutch 104a also has a tubular body which defines an inner bore. The inner bore extends between front and rear engagement ends 128a, 130a, each of which carries a plurality of clutching teeth configured to engage the corresponding clutching teeth of the front and rear driven gears 88a, 90a. The inner bore has a sufficient size to receive the inner propulsion shaft 52a and a portion of the outer hollow propulsion shaft 74a which is coaxially positioned about the inner propulsion shaft 52a. Internal splines extend from the wall of the inner bore proximate to the rear engagement end 130a of the clutch 104a, and mate with corresponding external splines on the exterior of the outer propulsion shaft 74a. The internal splines extend only partially over the axial length of the inner bore. The spline connection drivingly connects the clutch 104a to the outer propulsion shaft 74a, while allowing the clutch 104a to slide over the outer propulsion shaft 74a for operation, as explained below.

A clutch actuation mechanism 240 couples the clutches 102a, 104a together for simultaneous operation. The clutch actuation mechanism 240 includes a bushing sleeve 242 which passes through an inner bore of the front gear 88a and surrounds a portion of the inner propulsion shaft 52a in this position. The bushing is sized to smoothly slide over the inner propulsion shaft 52a and through the inner bore of the front gear 88a, as discussed below. The bearing sleeve desirably is coupled to the inner shaft in a manner which allows the sleeve to slide over the shaft in the forward and rearward directions, but which causes the sleeve to rotate with the inner shaft. The bushing thus journals the shaft within the inner bore of the front gear. In the illustrated embodiment, the inner shaft includes a plurality of radially extending nibs 244 spaced about its circumference. The nibs 244 cooperate with slots 246 formed in the sleeve 242 to allow the sleeve 242 to slide over the shaft 52a, but to cause the sleeve 242 to rotate with the shaft 52a.

As seen in FIG. 7, the ends of the bearing sleeve 242 are fixed to the front and rear clutches 102a, 104a. The front clutch 102a includes a threaded counterbore 248 which extends into the tubular body of the clutch 102a from its front engagement end 108a. The threaded counterbore 248 is sized to receive a threaded front end 250 (see FIG. 8) of the bearing sleeve 242. This coupling interconnects the front clutch 102a and the bearing sleeve 242 without interfering with the ability of these elements to slide over the inner propulsion shaft 52a. This coupling also eliminates the need for additional fasteners so as to simplify assembly and disassembly.

A flared rear end 252 of the bearing sleeve 242 is captured within the inner bore of the rear clutch 104a at its front end. In the illustrated embodiment, the flared rear end 252 is captured between a pair of anti-friction washers 254 which are fixed within the inner bore of the rear clutch 104a by a pair of retaining washers 256. The retaining washers 256 are detachably fixed within the inner bore of the rear clutch 102a by snapping into corresponding grooves formed within the inner bore, as known in the art. The rear clutch 104a can rotate relative to the bearing sleeve 242 with the flared rear end 252 of the bearing sleeve 242 captured between, but not attached to the washers 256. The flared end 252 can freely rotate between the anti-friction washers 254.

The bearing sleeve 242 links the clutches 102a, 104a together with its ends coupled to the clutches 102a, 104a. The bearing sleeve 242 thus causes the rear clutch 104a to follow the movement of the front clutch 102a.

To establish a forward drive condition, the shift rod 142a rotates the cam member 140a in a manner which moves the drive pin 144a axially in the rearward direction. The drive pin 144a moves the front clutch 102a rearward to slide the front clutch 102a over the inner propulsion shaft 52a and to force the front clutch 102a into engagement with the front gear 88a with the corresponding clutching teeth mating. So engaged, the front clutch 88a drives the inner propulsion shaft 52a through the spline connection between the clutch 102a and the inner propulsion shaft 52a. The inner propulsion shaft 52a thus drives the rear propeller 40a in a first direction to assert a forward thrust.

As understood from FIG. 7, forward motion of the front clutch 102a also slides the bearing sleeve 242 over the inner propulsion shaft 52a and through the front gear 88a to actuate the rear clutch 104a. The bearing sleeve 242 thus positively forces the rear clutch 104a to engage the rear gear 90a with the corresponding clutching teeth mating. So engaged, the rear clutch 104a drives the outer propulsion shaft 74a through the spline connection between the rear clutch 104a and the outer propulsion shaft 74a. The outer propulsion shaft 74a in turn drives the front propeller 38 to spin in an opposite direction to that of the rear propeller and to assert a forward thrust.

To establish a reverse drive condition, the shift rod 142a rotates to move the drive pin 144a and front clutch 102a in the forward direction. Forward motion of the front clutch 102a also slides the bearing sleeve 242 over the inner propulsion shaft 52a and through the front gear 88a to actuate the rear clutch 104a in this direction. The bearing sleeve 242 thus positively pulls the rear clutch 104a to engage the front gear 88a. The corresponding teeth of the front gear 88a and the rear clutch 104a mate to establish a drive condition. So engaged, the front gear 88a drives the outer propulsion shaft 74a through the spline connection between the rear clutch 104a and the outer propulsion shaft 74a. The outer propulsion shaft 74a thus drives the front propeller 38 to spin in a direction to assert a rearward thrust and drive the watercraft in reverse.

It is to be understood that the operation of the transmission described in connection with FIG. 3 operates in a similar manner to that described above. The plunger 106 rather than the bearing sleeve 242 causes the rear clutch to follow the front clutch. The operation is otherwise identical. A further description is therefore believed unnecessary for an understanding of the present invention.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A marine outboard drive comprising a lower unit housing including first and second threaded apertures, a bearing carrier adapted to generally fit within said lower unit housing, said bearing carrier including an externally threaded first end configured to screw into said first threaded aperture of said lower unit housing, and an externally threaded ring nut configured to screw into said second aperture and to cooperate with a second end of said bearing carrier to fix said bearing carrier within the lower unit housing with said first end screwed into said first aperture, the external threads on said ring nut being of the same hand as that of the external threads on said bearing carrier first end.

2. The outboard drive of claim 1, wherein said external threads of said bearing carrier first end and of said ring nut have different thread pitches.

3. The outboard drive of claim 2, wherein the thread pitch of the external threads on said bearing carrier first end is larger than the thread pitch of the external threads of said ring nut.

4. The outboard drive of claim 1 additionally comprising a first propulsion shaft which extends through and is journaled within said bearing carrier.

5. The outboard drive of claim 4 additionally comprising a hollow second propulsion shaft which extends through at least a portion of said bearing carrier with said first propulsion shaft extending through said hollow second propulsion shaft.

6. The outboard drive of claim 4 additionally comprising a transmission housed within said lower unit housing, said transmission selectively coupling said propulsion shaft to a drive shaft, at least a portion of said transmission being disposed within said first end of said bearing carrier with said bearing carrier coupled to said lower unit housing.

7. The outboard drive of claim 4, wherein said propulsion shaft drives a propeller device.

8. The outboard drive of claim 1, wherein said ring nut abuts said second end of said bearing carrier when said ring nut is fully threaded into said second aperture of said lower unit housing.

9. The outboard drive of claim 8, wherein at least a portion of said second end of said bearing carrier lies within said second aperture of said lower unit housing with said bearing carrier first end threaded into said first aperture.

10. A marine outboard drive comprising a lower unit housing, a propulsion shaft bearing carrier including first and second ends, said first end of the bearing carrier and said lower unit housing together including a first pairing of interengaging coupling elements which couple the bearing carrier to the lower unit housing when said bearing carrier is rotated about its longitudinal axis in a first rotational direction, and a ring nut said lower unit housing and cooperate with the second end of said bearing carrier to fix said bearing carrier to said lower trait housing, said ring nut and said lower unit housing together including a second pairing of interengaging coupling elements which couple the ring nut to the lower unit housing when the ring nut is rotated relative to said lower unit housing in said first rotational direction.

11. The outboard drive of claim 10, wherein said first pairing of interengaging coupling elements comprises cooperating internal and external threads, said first end of said bearing carrier carries the external thread, and the internal thread is formed within a first threaded aperture of the lower unit housing such that the first end of the bearing carrier is screwed into the first threaded aperture of said lower unit housing to connect the bearing carrier to the lower unit housing.

12. The outboard drive of claim 11 additionally comprising a transmission positioned within said lower unit housing proximate to said aperture.

13. The outboard drive of claim 12, wherein at least a portion of said transmission extends into said aperture.

14. The outboard drive of claim 11, wherein the second pairing of the interengaging elements comprises cooperating internal and external threads, said ring nut carries the external thread which is configured to engage a second threaded aperture disposed at a rear end of said lower unit housing and in which the internal thread is formed, and the external threads on the first end of the bearing carrier and the external threads of the ring nut are of the same hand.

15. The outboard drive of claim 14, wherein said external threads of said bearing carrier first end and of said ring nut have different thread pitches.

16. The outboard drive of claim 15, wherein the thread pitch of the external threads on said bearing carrier first end is larger than the thread pitch on the external threads of said ring nut.

17. The outboard drive of claim 14, wherein said ring nut abuts said second end of said bearing carrier when said ring nut is fully threaded into said first aperture of said lower unit housing.

18. The outboard drive of claim 17, wherein at least a portion of said second end of said bearing carrier lies within said second threaded aperture of said lower unit housing with said bearing carrier first end threaded into said first threaded aperture.

19. The outboard drive of claim 17 additionally comprising a locking tab washer positioned between said second end of said bearing carrier and said ring nut, and a first portion of said washer is positioned to engage said lower unit housing and a second portion of said washer is positioned to engage said ring nut.

* * * * *